United States Patent [19]

Hale

[11] 4,328,770

[45] May 11, 1982

[54] INTERNAL COMBUSTION ENGINE WITH DIE CASTABLE LOOP TRANSFER SYSTEM

[75] Inventor: David J. Hale, Picket, Wis.

[73] Assignee: Brunswick Corporation, Skokie, Ill.

[21] Appl. No.: 211,436

[22] Filed: Nov. 28, 1980

[51] Int. Cl.[3] ..... F02B 33/04; F02B 75/20

[52] U.S. Cl. ..... 123/59 B; 123/65 P; 123/73 R; 123/73 PP; 123/74 R

[58] Field of Search ..... 123/59 B, 73 PP, 73 R, 123/73 A, 65 P, 74 R, 74 B, 65 PD, 193 C

[56] References Cited

U.S. PATENT DOCUMENTS

| | | | |
|---|---|---|---|
| 2,190,011 | 2/1940 | Boxan | 123/65 A |
| 2,227,500 | 1/1941 | Johnson et al. | 123/41.74 |
| 2,643,510 | 6/1953 | Kiekhaefer | 123/59 B |
| 2,729,204 | 1/1956 | Meyer | 123/59 B |
| 3,059,624 | 10/1962 | Torre | 123/59 B |
| 3,105,474 | 10/1963 | Kiekhaefer | 123/59 B |
| 3,971,297 | 7/1976 | Fox | 123/73 PP |
| 4,092,958 | 6/1978 | Hale | 123/73 PP |
| 4,242,993 | 1/1981 | Onishi | 123/59 B |
| 4,306,522 | 12/1981 | Fotsch | 123/73 PP |

*Primary Examiner*—Wendell E. Burns

[57] ABSTRACT

An in-line, multi-cylinder, two-cycle loop charged engine 10 has transfer passages 21, 22, and 23 partially formed by cavities die-cast in the cylinder block 14. The transfer passages are completed by covers, 24 and 25 bolted to the block 14. An efficient loop charging system is thus provided in a completely die-cast cylinder block.

11 Claims, 15 Drawing Figures

INTERNAL COMBUSTION ENGINE WITH DIE CASTABLE LOOP TRANSFER SYSTEM

This invention relates to internal combustion engines and particularly to a two-cycle engine having a die castable cylinder block with a loop transfer system.

BACKGROUND ART

The engines for outboard motor units and the like are generally of the two-cycle type with pressurized crankcase charging of the cylinders. The charge is introduced in either of two distinct methods known respectively as cross charging and scavenging and as loop charging and scavenging. Conventional cross charging and scavenging permits simplified manufacturing and minimizing of cost. In such systems, a deflector piston is employed to properly expose the exhaust port and the input port, which are located on opposite sides of the cylinder. The input charge, which may be a fuel-air charge or only air in fuel injection systems, is derived from the pressurized crankcase and moves across the piston and is then deflected upward to scavenge the exhaust gases while introducing the new charge. Although simple and relatively inexpensive, the system does not provide a highly efficient and effective scavenging and charging flow.

Loop scavenging is generally more efficient and thus produces a greater power output per cubic inch of piston displacement with a smaller fuel usage per horsepower per hour consumption when compared to cross scavenged engines. In loop scavenging, a pair of side input ports oppositely located in the cylinder directs the charges toward the rear of the cylinder and, with a finger port, develops a loop path through the cylinder with a wave moving from the back of the cylinder up the combustion chamber then back down to the exhaust port on the opposite side of the cylinder. Thus, the incoming charges meet with each other and with the upward charge from the finger port adjacent the back wall of the cylinder, sweep upwardly across the back of the cylinder, and then over and downward in a distinct loop to the exhaust port. Although more efficient, the opposed dual input porting increases the complexity and the cost of casting the cylinder block.

In some loop charged engines, such as that disclosed in U.S. Pat. No. 4,092,958, the charging ports and their associated transfer passages are defined by "blister" type cylinder liners which are integrally cast into the block. Other loop charged engines have used sand cores to form the transfer passages.

U.S. Pat. Nos. 3,149,383 and 2,288,902 disclose die cast cylinder blocks wherein the forming dies are withdrawn along the cylinder axes. These arrangements do not permit optimum shaping of the transfer passages, since no contouring of the lower surfaces of the transfer passage can be achieved.

U.S. Pat. No. 2,227,500 discloses a cross scavenged, two-cycle engine having a two cylinder die cast cylinder block with one transfer passage for each cylinder. The transfer passage and exhaust ports are directly opposed on opposite sides of the cylinder block and a cover is provided to complete the transfer passage on each cylinder.

Another block arrangement, suitable to allow die casting of a cross scavenged engine is shown in FIG. 7 of U.S. Pat. No. 2,731,960. In this engine the forming die for the transfer passage and crankcase is withdrawn laterally in a direction parallel to the crankshaft. A cover for the transfer passage is formed integrally with a crankshaft bearing cage.

Finally, U.S. Pat. No. 2,190,011 discloses several two-cycle engines in which lateral inserts are used to form the upper portion of the transfer passage.

DISCLOSURE OF INVENTION

An in-line, multi-cylinder, two-cycle loop charged engine has at least two transfer passages for each cylinder to transfer an air-fuel charge from the crankcase to the combustion chamber. The engine's die-cast cylinder block includes a bank of parallel cylinders with a first transfer cavity for each of the cylinders. The first transfer cavity defines a portion of the first transfer passage extending from the inlet opening to the inlet port and is free of projections which would prevent the withdrawal of a forming die in a first direction perpendicular to the axes of the cylinders. An exhaust cavity is also provided for each of the cylinders to form an exhaust passage, with the exhaust cavities also free of projections which would prevent withdrawal of a forming die in the first direction. Thus both the first transfer passage and exhaust passage may be die-cast.

Second and third transfer cavities may also be provided on the opposite side of the cylinder block. These cavities are also free of projections to allow withdrawal of forming dies in a direction opposite to the first direction. All of the transfer passages of a loop charged engine may thereby be die-cast in the cylinder block.

The transfer passages are completed by covers for the transfer cavities. Continuously curved transfer passages may thus be formed from die-cast parts to economically produce an efficient loop charged engine.

BEST MODE FOR CARRYING OUT THE INVENTION

Figure 1:
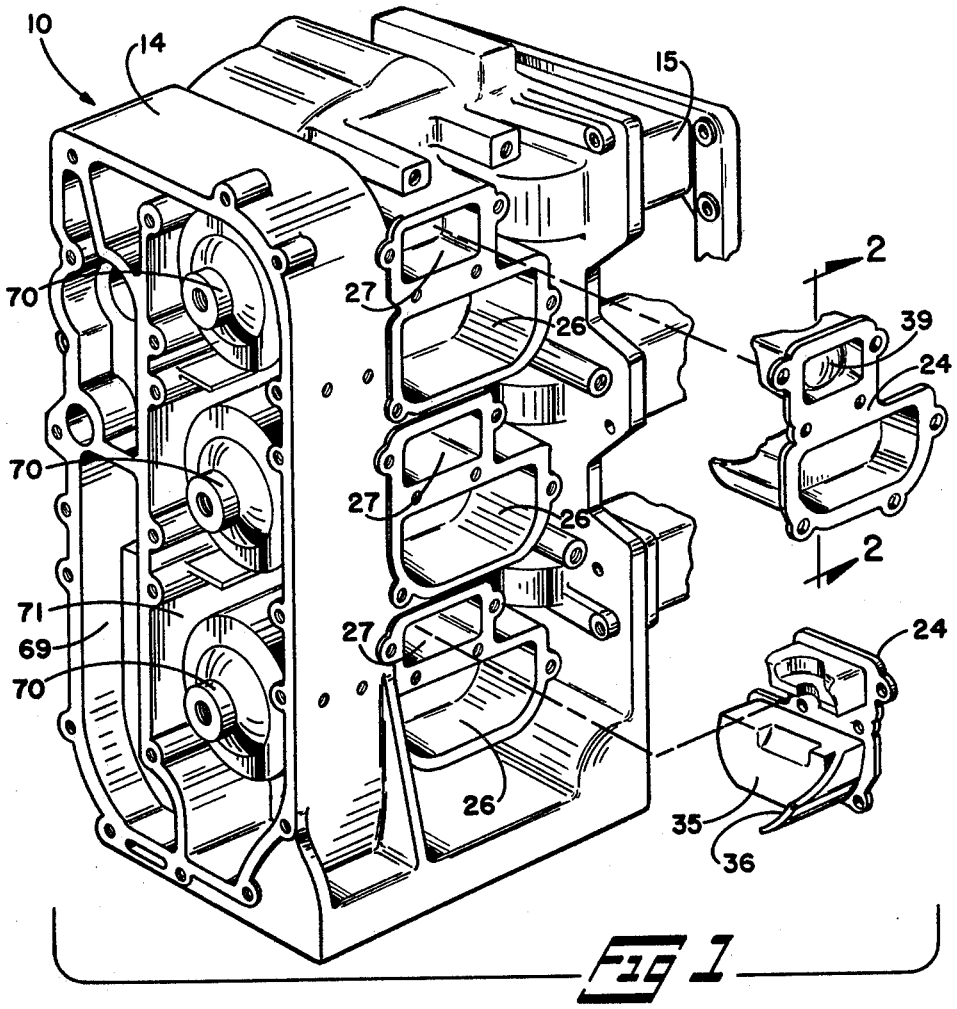
FIG. 1 is an exploded perspective view showing the head end and transfer side of the engine according to the present invention.
Figure 2:
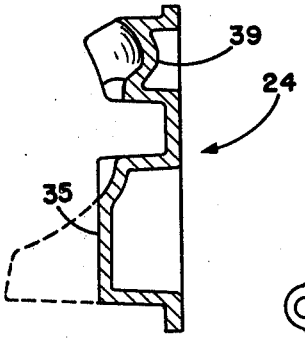
FIG. 2 is a sectional view taken along line 2—2 of FIG. 1.
Figure 3:
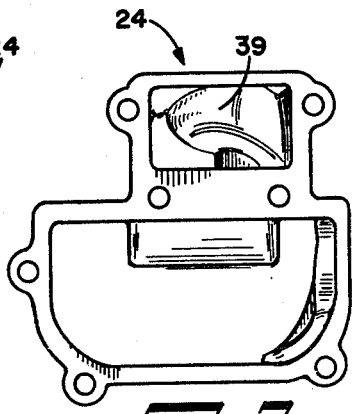
FIGS. 3 and 4 are views of the transfer passage covers shown in FIG. 1.
Figure 4:
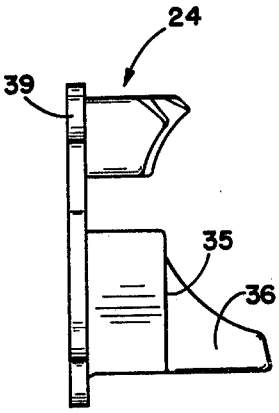

Referring to the drawings, a two-cycle, three cylinder, in-line engine 10 for incorporation in an outboard motor is illustrated. The engine 10 is of the crankcase compression type and has three vertically aligned cylinders 11 with the axes of the cylinders lying in a vertical plane and has a vertical crankshaft 12. A closed crankcase compartment 13 for each cylinder 11 is defined by the crankcase end of the cylinder block 14 and the intake manifold casting 15. The air-fuel charge is transferred from the crankcase compartments 13 to the cylinders 11 by a system of three transfer ports 16, 17, and 18 for each cylinder 11, with the transfer ports arranged to provide a loop charging flow when the transfer ports are uncovered by the piston 19. A tuned exhaust system is provided on the exhaust side of the engine block to receive the exhaust from the exhaust port 20 of each cylinder 11.

Figure 12:
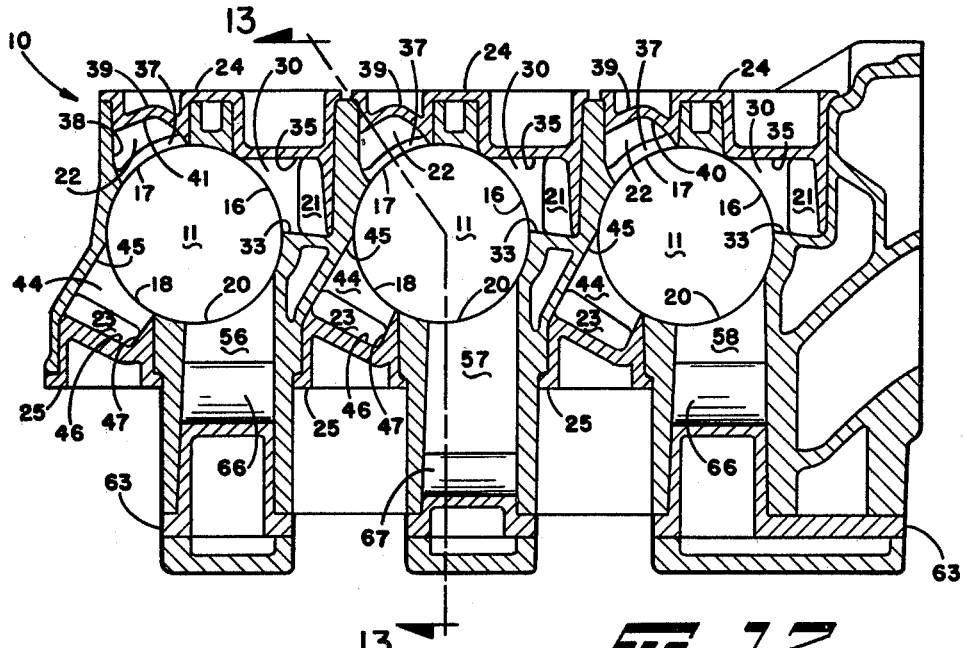
FIG. 12 is a sectional view taken along line 12—12 of FIG. 10.

The engine 10 is particularly designed to permit the cylinder block 14 to be die-cast from aluminum while providing a good loop charging system having optimally shaped transfer passages 21, 22 and 23. As shown in FIG. 12, the ports of each cylinder are similarly angularly oriented, with the transfer passages 21, 22 and 23 of adjacent cylinders 11 overlapping to reduce the height of the engine 10. The transfer passages 21, 22 and 23 are partially formed by the cylinder block casting 14 and are completed by port covers 24 and 25 which are bolted to the block 14.

Figure 13:
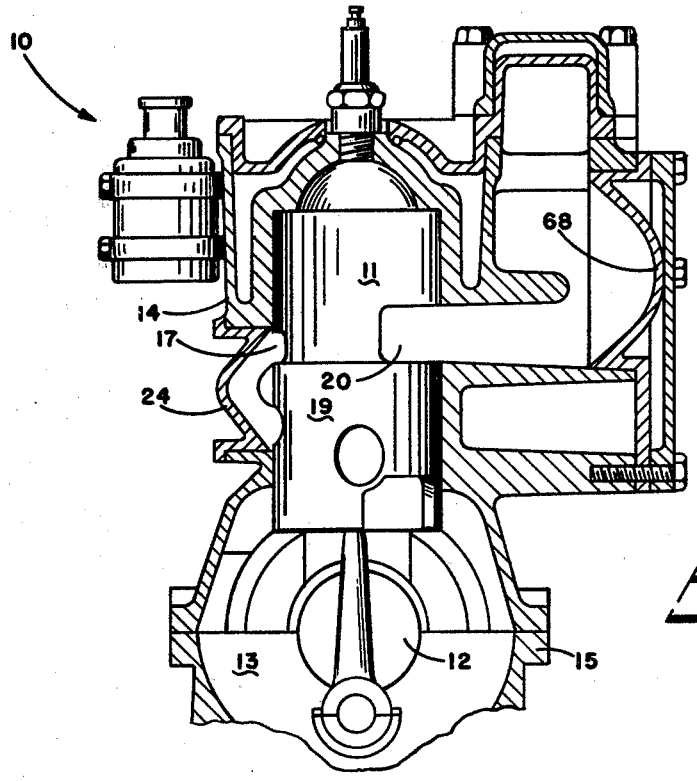
FIG. 13 is a sectional view taken along line 13—13 of FIG. 12.

On the transfer side of the block 14, as most clearly seen in FIGS. 1, 12 and 13, cavities 26 and 27 shaped in the cylinder block 14 by forming dies partially define both the bottom input transfer passage 21 and the auxiliary transfer passage 22 for each cylinder 11. The cavities are shaped to allow withdrawal of the forming die in a direction perpendicular to the plane of the cylinders 11. The surfaces of the bottom inlet transfer passage on the bridge 30 between the inlet port 16 and the inlet opening 32, the wall 33 adjacent the exhaust port 20, and part of the outside wall 34 are shaped by the forming die. The transfer side inlet port covers 24, as most clearly shown in FIGS. 1–4 and FIG. 10 define the remaining surfaces of the inlet transfer passage 26, i.e., the transfer passage wall 35 adjacent the auxiliary transfer passage 22 as well as the remaining portion 36 of the outside wall. Still on the transfer side of the block, the interior surfaces of the auxiliary transfer passage 22 on the bridge 37 and on the top wall 38 are also defined by the transfer side forming die. The auxiliary port covers 39 complete the auxiliary transfer passages 22 by defining the bottom 40 and outside walls 41.

Figure 5:
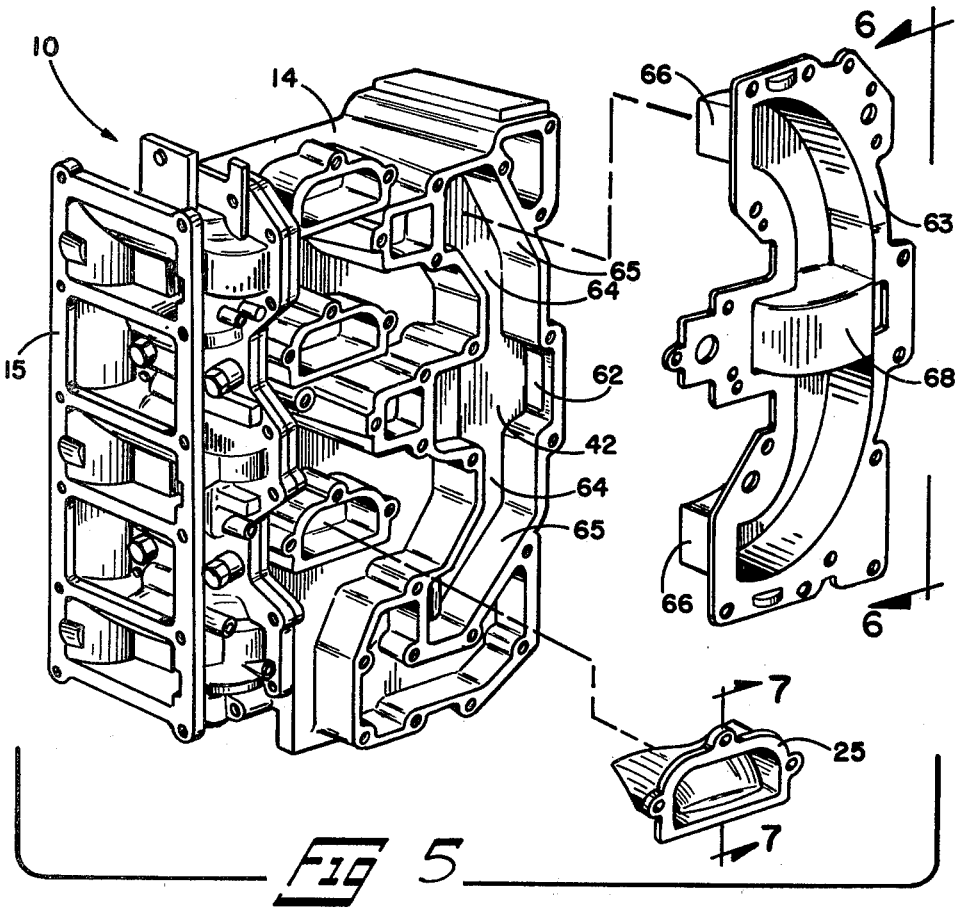
FIG. 5 is an exploded perspective view showing the crankcase end and exhaust side of the engine of FIG. 1.
Figure 6:
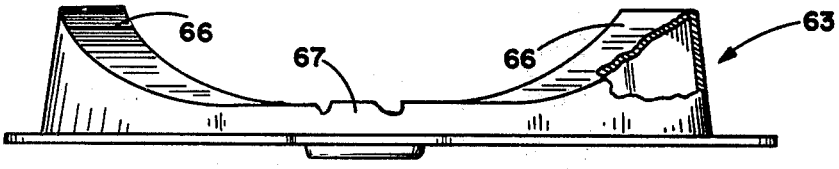
FIG. 6 is a side view of the exhaust cover shown in FIG. 5.
Figure 7:
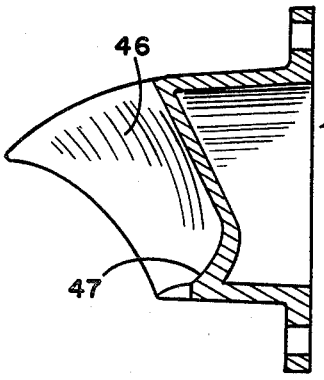
FIGS. 7 and 8 are views of the exhaust side transfer passage covers shown in FIG. 5.
Figure 8:
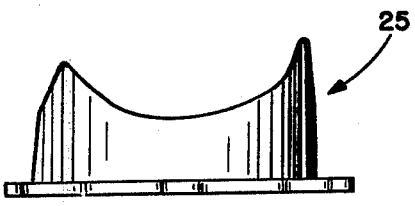
Figure 9:
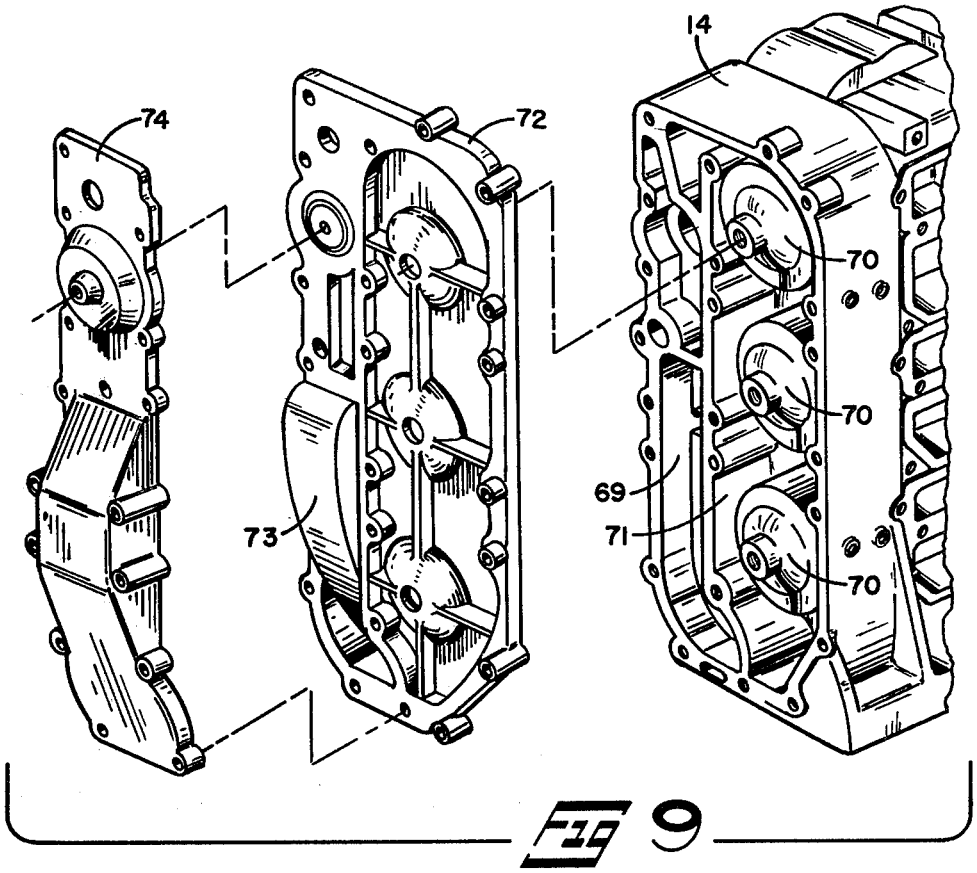
FIG. 9 is an exploded perspective view illustrating the head end of the cylinder block and the associated exhaust cover and water jacket cover.
Figure 10:
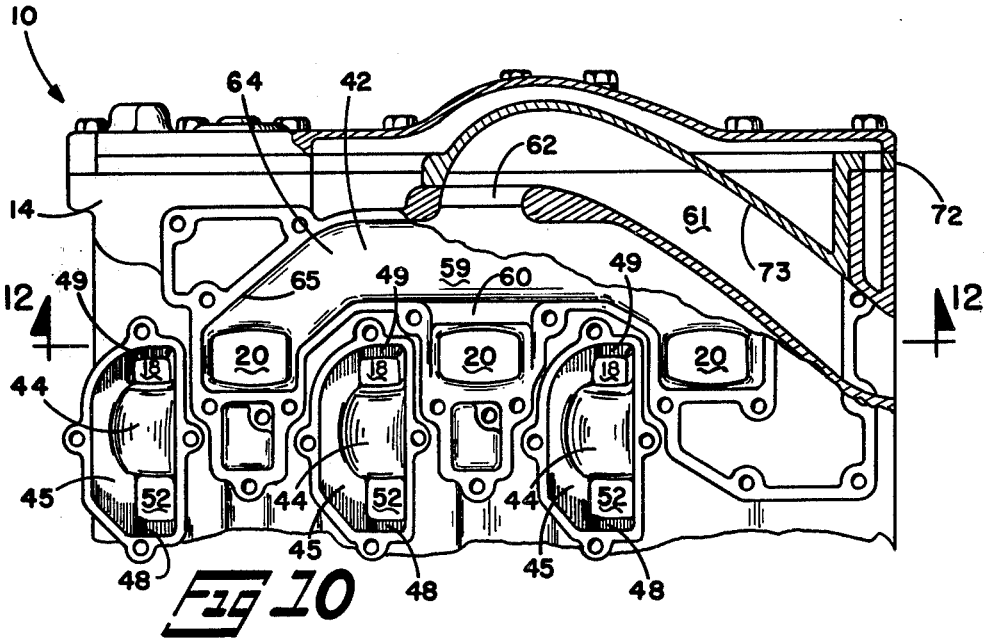
FIG. 10 is a partial sectional view of the engine of FIG. 1 showing the exhaust passage.
Figure 11:
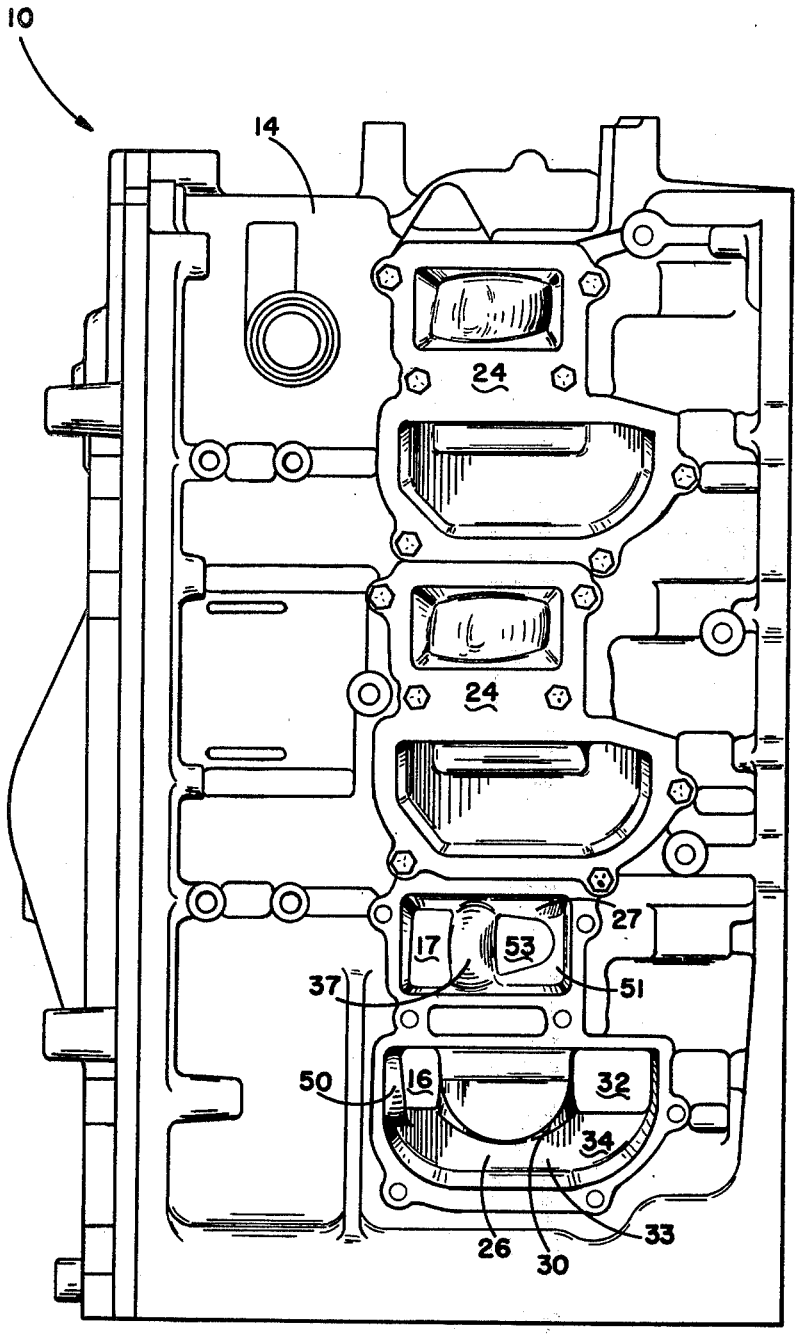
FIG. 11 is an elevation showing the transfer side of the engine.

On the exhaust side of the engine, as most clearly seen in FIGS. 5, 10 and 12, cavities shaped in the cylinder block 14 partially define the exhaust passages 42 and ports 20 and the top input transfer passages 23. Like the transfer side forming die, the exhaust side forming die is withdrawn perpendicular to the plane of the cylinders 11. The surfaces of the top input transfer passage 23 on the bridge 44 and the wall 45 adjacent the auxiliary transfer passage 22 are shaped by the exhaust side forming die. The remaining surfaces, the outside walls 46 and the walls 47 adjacent the exhaust port 20 are formed by the exhaust side input port covers 25, shown in detail in FIGS. 5, 7, and 8, which bolt to the cylinder block 14.

At the junctions of the transfer passage surfaces with the transfer ports 16, 17 and 18 and inlet openings 32 and 52, rims 48, 49, 50 and 51 have been formed in the block adjacent the ports. The rims eliminate the possibility of the port cover extending into the cylinders 11 and allow thicker sections to be used in the port covers 24 and 25.

The die-cast cylinder block 14 and the inlet port covers 24 and 25 allow the formation of a loop charging system with transfer passages having the complex shapes necessary for efficient loop charging. The two inlet transfer passages 21 and 23 are essentially mirror images of each other and have planar sidewalls which converge slightly toward the cylinders 11. Each input transfer passage 21 and 23 has a generally rectangular cross section with the sidewalls joined to the inside wall on the bridge and to an outside wall. The inside wall and outside wall are smoothly curved to define a gradually constricting passageway from the inlet openings 32 and 52 to the inlet ports 16 and 18. At the inlet ports 16 and 18, the inlet passages are angled to direct the incoming charge essentially parallel to the face of the piston 19 and toward the auxiliary port 17.

The auxiliary transfer passage 22, positioned directly opposite the exhaust port 20, has curved walls on both the bridge 37 and outside wall 41 to define a passage constricting from the inlet opening 53 to the inlet port 17. The auxiliary passage 22 is angled toward the head end of the cylinder 11 to direct the input flow toward the head to enhance the looping flow of the incoming charge.

Figure 14:
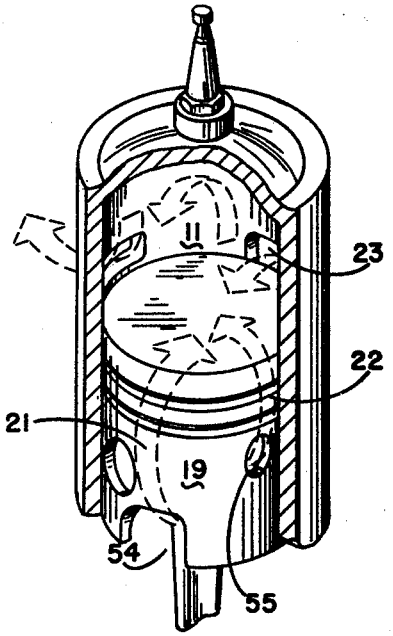
FIG. 14 is a perspective view illustrating the charge flow pattern in a cylinder.
Figure 15:
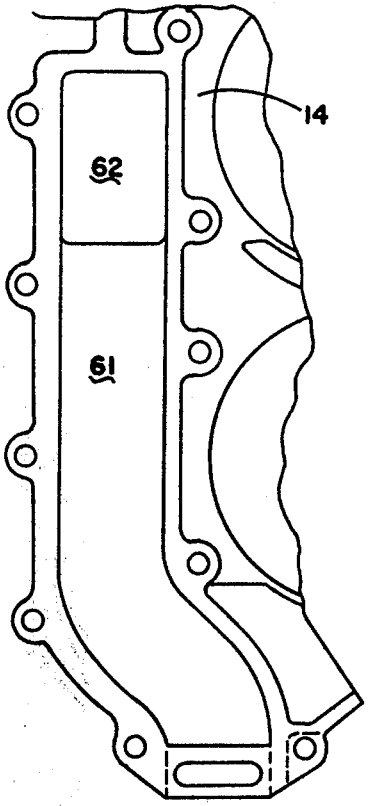
FIG. 15 is a partial view in elevation of the head end of the cylinder block.

Thus, as shown in FIG. 14, the input charge developed in the crankcase 13 will be introduced into the transfer passages as the edge skirt openings 54 in the piston 19 come into alignment with the inlet openings and as the side wall opening 55 in the piston 19 comes into alignment with the auxiliary inlet opening. The incoming flow from the inlet ports 16 and 18 will sweep across the face of the piston 19 converging toward the auxiliary port 17, mix with the flow from the auxiliary up toward the cylinder head, and then drop down toward the exhaust port 20 to produce a highly efficient loop charging of the cylinder.

In general, the exhaust system includes three branches 56, 57 and 58 from the three cylinders 11 in a direction perpendicular to the plane of the cylinders. The top and bottom branches 56 and 58 then turn toward each other at the head end of the block and meet in vertical alignment, forming a vertically extending trunk 59. The center branch 59 is separated from the vertical branches by a partition wall 60 and turns back toward the head end of the block to join the other branches on the outer side of the trunk. An exhaust gas outlet passageway 61 connects with a port 62 at the head end of the manifold turns downward and out the base of the block.

The internal surfaces of the exhaust manifold are formed partially by the cavities die-cast in the block 14 and partially by an exhaust manifold cover 63 which bolts to the block. The three branches 56, 57 and 58 of the exhaust manifold extending perpendicular to the plane of the cylinders are shaped by the exhaust side forming die, as are the surfaces 64 of the top and bottom legs adjacent the cylinders 11 and the walls 65 of the manifold perpendicular to the plane of the cylinders, as shown in FIGS. 5, 10, 12 and 13. The outside surfaces of the manifold are defined by the die-cast manifold cover 63, shown in FIGS. 5 and 13, which includes portions 66 extending in toward the top and bottom exhaust ports to turn the exhaust flow from those ports along the side of the cylinder block 14. At the center of the manifold cover, a portion 67 of the cover extends in toward the center exhaust port to turn the exhaust flow toward the head end of the block 14 and a recessed portion 68 extends out past the outer surface of the top and bottom branches to provide additional length to the center branch, as shown in FIG. 13.

At the head end of the block 14 a recess 69 is provided to form the exhaust outlet passage 61. The bottom and sides of the outlet passageway are shaped by the head forming die, which also forms the exterior of the cylinder heads 70 and a water jacket 71 surrounding the cylinder 11. The cover 72 for the cylinder water jacket includes a curved surface 73 defining the outer surface of the exhaust outlet passageway 61 to provide an outlet passageway having an essentially constant cross-sectional area. Finally, an exhaust outlet water jacket cover 74 is attached to the cylinder water jacket cover 72 to define an outer water jacket for the exhaust outlet passageway 61.

The invention thus provides an efficient, loop charged engine with a cylinder block which may readily be die-cast.

What is claimed is:

1. An in-line, multi-cylinder, two-cycle, loop charged engine of the type having at least two transfer passages for each cylinder to transfer an air-fuel charge from the crankcase to the combustion chamber, each of said transfer passages having an inlet opening and an inlet port through the wall of a cylinder, said engine including a die-cast cylinder block comprising:

(A) a bank of parallel cylinders;

(B) a first transfer cavity for each of said cylinders defining a portion extending from said inlet opening to said inlet port of a first one of said transfer passages, said first cavity being free of projections which would prevent the withdrawal of a forming die in a first lateral direction, and (C) an exhaust cavity for each of said cylinders defining an exhaust passage, said exhaust cavities being free of projections which would prevent the withdrawal of a forming die in said first direction.

2. The engine defined in claim 1 wherein said cylinder block further comprises:

(D) a second transfer cavity for each of said cylinders defining a portion extending from said inlet opening to said inlet port of a second one of said transfer passages, said second transfer cavities being free of projections which would prevent the withdrawal of a forming die in a second lateral direction generally opposite to said first direction and generally diametrically opposed to said first transfer cavities.

3. The engine defined in claim 2 wherein said cylinder block further comprises:

(E) a third transfer cavity for each of said cylinders defining a portion extending from said inlet opening to said inlet port of a third transfer passage, said third transfer cavities being generally diametrically opposed to said exhaust cavity and free of projections which would prevent the withdrawal of a forming die in said second direction.

4. The engine defined in claims 2 or 3 further comprising a cover for each of said transfer cavities, said covers being shaped to define the remaining portions of said transfer passages.

5. The engine defined in claim 4 wherein each of said transfer passages is continuously curved from said inlet opening to said inlet port.

6. The engine defined in claim 5 wherein each of said transfer passages continuously converge from said inlet opening to said inlet port.

7. The engine defined in claim 6 wherein said second direction is opposite to said first direction.

8. The engine defined in claim 7 wherein said first direction is perpendicular to the axes of said cylinders.

9. The engine defined in claim 8 wherein said first direction is perpendicular to the plane of said cylinder bank.

10. The engine defined in claim 9 wherein said first and second transfer passages for each cylinder each have essentially planar sidewalls converging toward said cylinder.

11. The engine defined in claim 10 wherein a cylinder head is formed integral with said cylinder block.

* * * * *